US006571531B2

(12) United States Patent
Kasel

(10) Patent No.: US 6,571,531 B2
(45) Date of Patent: Jun. 3, 2003

(54) STRAP DETECTOR ASSEMBLY

(75) Inventor: Calvin E. Kasel, Wauconda, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/824,356

(22) Filed: Apr. 2, 2001

(65) Prior Publication Data

US 2002/0139085 A1 Oct. 3, 2002

(51) Int. Cl.[7] ..... B65B 57/08; B65B 11/08

(52) U.S. Cl. ..... 53/75; 53/582; 100/4; 100/26; 156/475; 156/363

(58) Field of Search ..... 53/582, 589, 53, 53/64, 508, 75; 100/4, 26; 156/64, 352, 363, 379, 475

(56) References Cited

U.S. PATENT DOCUMENTS 3,720,158 A * 3/1973 Sauer et al. ..... 100/26
4,836,873 A * 6/1989 Mitanihara et al. ..... 100/2
4,850,179 A * 7/1989 Takami ..... 100/26
5,722,214 A * 3/1998 Spatafora ..... 53/505
5,894,789 A * 4/1999 Huber ..... 100/32
6,038,967 A * 3/2000 Chak et al. ..... 100/2

* cited by examiner

*Primary Examiner*—Stephen F. Gerrity
*Assistant Examiner*—Paul Durand
(74) *Attorney, Agent, or Firm*—Mark W. Croll; Donald J. Breh; Welsh & Katz, Ltd.

(57) ABSTRACT

A strap detector is used with an automatic strapping machine. The strap detector includes a strap detector mounting bracket mounted to the automatic strapping machine, and a pivot block attached to the mounting bracket. The pivot block has an aperture formed therein. A shaft is positioned in the pivot block aperture, and a finger is mounted to a free end of the shaft. A guide block is positioned along the shaft and spaced from the free end, and a sensor is operatively coupled to the detector mounting bracket proximal the guide block. The finger is engaged by sealed strapping material and, when the strapping material is properly sealed, movement of the strapping head away from the articles moves the guide block into a position to change a state of the sensor.

12 Claims, 5 Drawing Sheets

STRAP DETECTOR ASSEMBLY

BACKGROUND OF THE INVENTION

The present invention relates to a strap detector assembly for automatic strapping machines. More particularly, the present invention relates to a detector for determining whether strapping material is properly positioned around and sealed to a load.

Strapping machines are typically used to strap articles or a load together. There are two principal types of strapping machines known in the art: (1) manual strapping machines; and (2) automatic strapping machines.

One type of automatic strapping machine includes a frame-like support for the overall machine, a strapping head, a chute around which the strap is fed and one or more dispensers for dispensing the strap material to the strapping head.

The strapping head moves toward the load, pulls the strap material from the dispensers, and conveys the strapping material to a first end of the chute until a leading portion of the strap returns to the strapping head. At the strapping head, the leading portion or leading end is gripped and the trailing portion or end of the strap is retracted and tensioned to provide an appropriate compression on the strapped load. The strap is then sealed to itself in an overlapping manner, the trailing end portion is severed and the load removed from the machine. The strapping head moves away from the load after each strapping operation has been completed. This process can be repeated for an extended period of time with very little human intervention.

However, occasionally, while the automatic strapping machine is operating without human intervention, the strapping material is improperly sealed around the load. In these circumstances, an improperly secured load results which can result in load tipping and spillage. This can result in the loss of load and labor resources. It would be impractical in terms of both man-hours and strapping operation time to require an employee to supervise automatic strapping machine operations.

Accordingly, there continues to be a need for an automatic strapping machine, or a device to be used with an automatic strapping machine, that ensures that strapping material is properly sealed around a load, thus facilitating a properly secured load.

SUMMARY OF THE INVENTION

The present invention relates to an automatic strapping machine configured to strap articles together by conveying strapping material into a first end of a chute. The strapping material exits the chute at a second end and is sealed to itself at a strapping head. The strapping head moves away from the articles after forming a seal and toward the articles to form the seal.

The automatic strapping machine comprises the strapping head and a strap detector mounting bracket mounted to the automatic strapping machine. In one embodiment, the strap detector mounting bracket can be mounted to the strapping head.

A pivot block can be attached to the mounting bracket, and the pivot block can have an aperture formed therein. A shaft can be positioned in the pivot block aperture, and a finger can be mounted to the shaft at a free end. A sensed element, such as a guide block, can be positioned along the shaft spaced from the free end.

A proximity sensor can be operatively coupled to the detector mounting bracket proximal the guide block. The finger can be engaged by sealed strapping material during a strapping operation and, if the strapping material is properly sealed to itself, movement of the strapping head away from the articles moves the guide block into a position to change a state of the sensor.

The automatic strapping machine can further include a notification device. The notification device can be actuated if the sensor state does not change after the strapping head moves away from the articles. Preferably, the notification device disables the strapping machine when it is actuated.

The automatic strapping machine can also include a biasing element positioned along the shaft, and positioned between the guide block and the pivot block. In one embodiment, the biasing element is a spring.

In one embodiment, the sensor is operatively coupled to the detector mounting bracket by the sensor support bracket. Preferably, an elongated slot is formed within the sensor support bracket and the sensor is connected to the sensor support at the elongated slot. Thus, the elongated slot allows for sensor position adjustment.

The guide block can include a guide attached to a bottom surface of the guide block and a cam groove can be formed within the detector mounting bracket. The cam groove and guide can be configured to cooperate with one another. The guide can be a bearing, and the sensor can be a proximity sensor.

Other features and advantages of the present invention will be apparent from the following detailed description, the accompanying drawings, and the appended claims.

BRIEF DESCRIPTION OF THE FIGURES

The benefits and advantages of the present invention will become more readily apparent to those of ordinary skill in the art after reviewing the following detailed description and accompanying drawings, wherein.

DETAILED DESCRIPTION OF THE INVENTION

Figure 1:
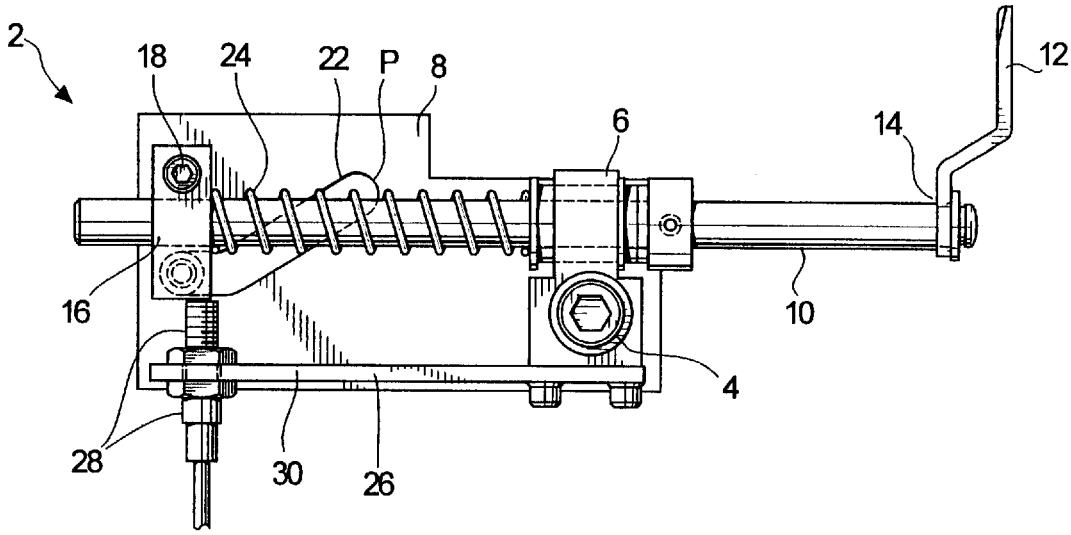
FIG. 1 is a top view of a detector assembly in the home state, embodying principles of the present invention.

While the invention is susceptible to various embodiments, there is shown in the drawings and will hereinafter be described specific embodiments with the understanding that the present disclosure is to be considered an exemplification of the invention and is not intended to limit the invention to the specific embodiments illustrated and described.

It is to be further understood that the title of this section of the specification, namely, "Detailed Description of the Invention," relates to a requirement of the United States Patent and Trademark Office, and does not imply, nor should be inferred to limit the subject matter disclosed herein and the scope of the present invention.

Figure 2:
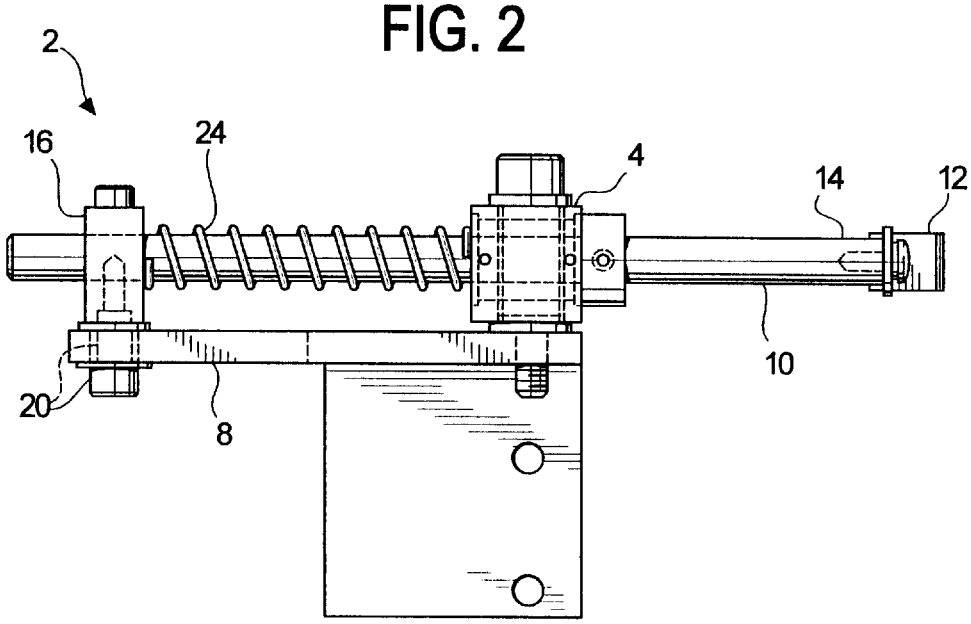
FIG. 2 is a side view of the detector assembly of FIG. 1.

Referring to the figures, and in particular to FIGS. 1 and 2, there is shown an exemplary strap detector assembly 2 for automatic strapping machines embodying the principles of the present invention. The detector assembly 2 includes a pivot block 4 with a shaft aperture 6 formed therein. The pivot block 4 is mounted to a strap detector mounting bracket 8 and is configured to pivot about the mounting bracket 8. A shaft 10, having a finger 12 mounted to the shaft 10 at a free end 14, is positioned within the shaft aperture 6. A sensed element, such as the illustrated guide block 16, which is spaced from the finger 12, is also attached to the shaft 10. Preferably, as shown in FIGS. 1–2, the guide block 16 is attached by connectors 18 that allow for the guide block 16 position to be adjusted along the shaft 10.

A guide 20, such as a pin or bearing, is connected to a bottom surface of the guide block 16, and a cam groove 22 is formed within the strap detector mounting bracket 8. The guide 20 and cam groove 22 are configured to cooperate with one another so the guide 20 can move along a path P defined by the cam groove 22. Preferably, a biasing element 24, such as, for example, a spring, is positioned along the shaft 10, and positioned between the guide and pivot blocks 16, 4.

The illustrated detector assembly 2 also includes a sensor support bracket 26 attached to the pivot block 4, and a sensing element 28, such as a proximity sensor, connected to the sensor support bracket 26. In the illustrated embodiment, the sensing element 28 is positioned proximal the guide block 16 while in a home state position (FIG. 1). Preferably, an elongated slot 30 is formed within the sensor support bracket 26 to allow for lateral adjustment (toward and away from the pivot block 4) of the sensing element 28 position along the sensor support bracket 26.

Figure 3A:
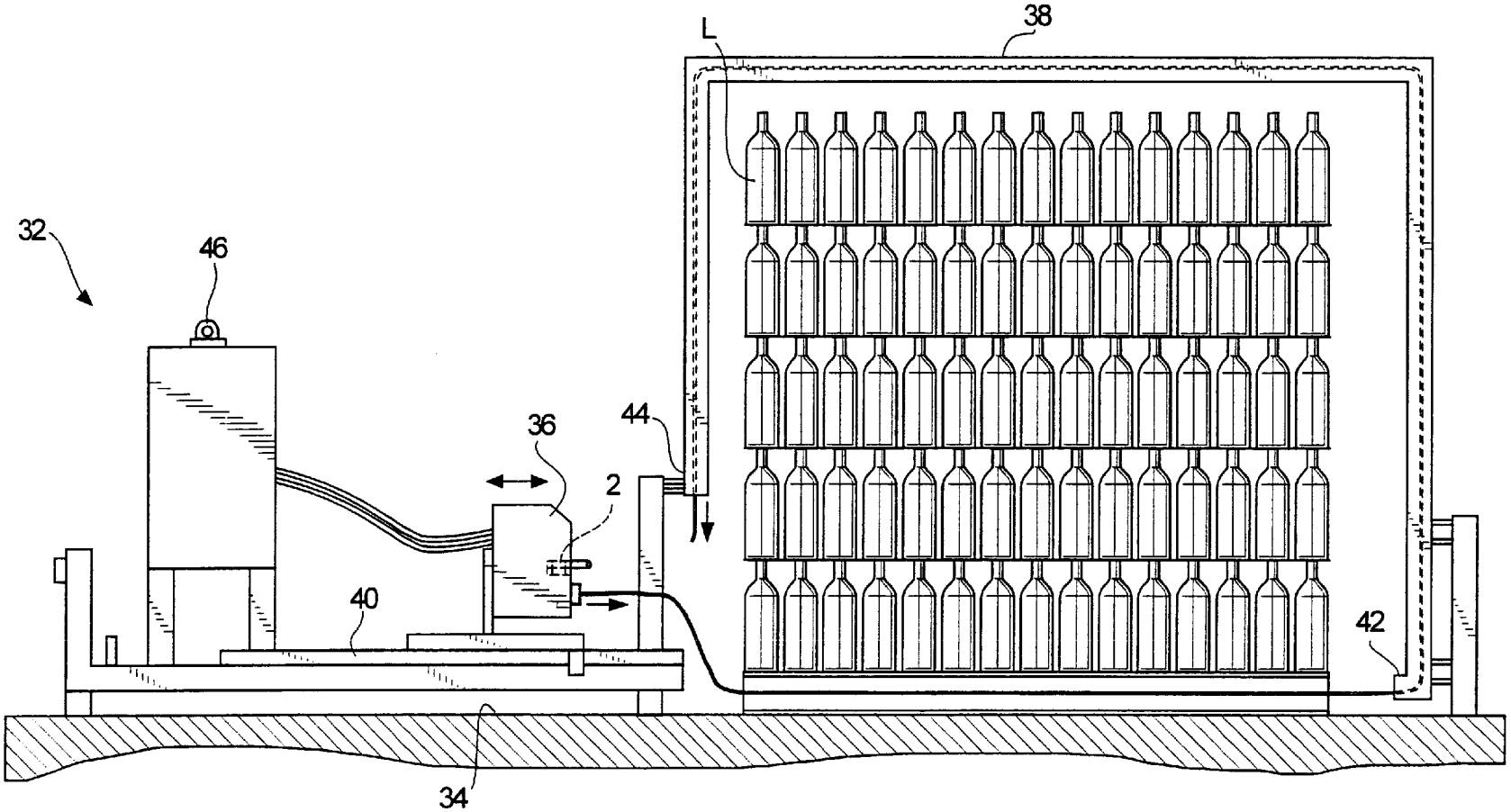
FIG. 3 is a front schematic view of an automatic strapping machine with the detector assembly of FIG. 1 attached thereto; and, FIGS. 3*a–c* demonstrate the sequence of operations of the strap detector of FIG. 1 as it interacts with a package to be wrapped.
Figure 3B:
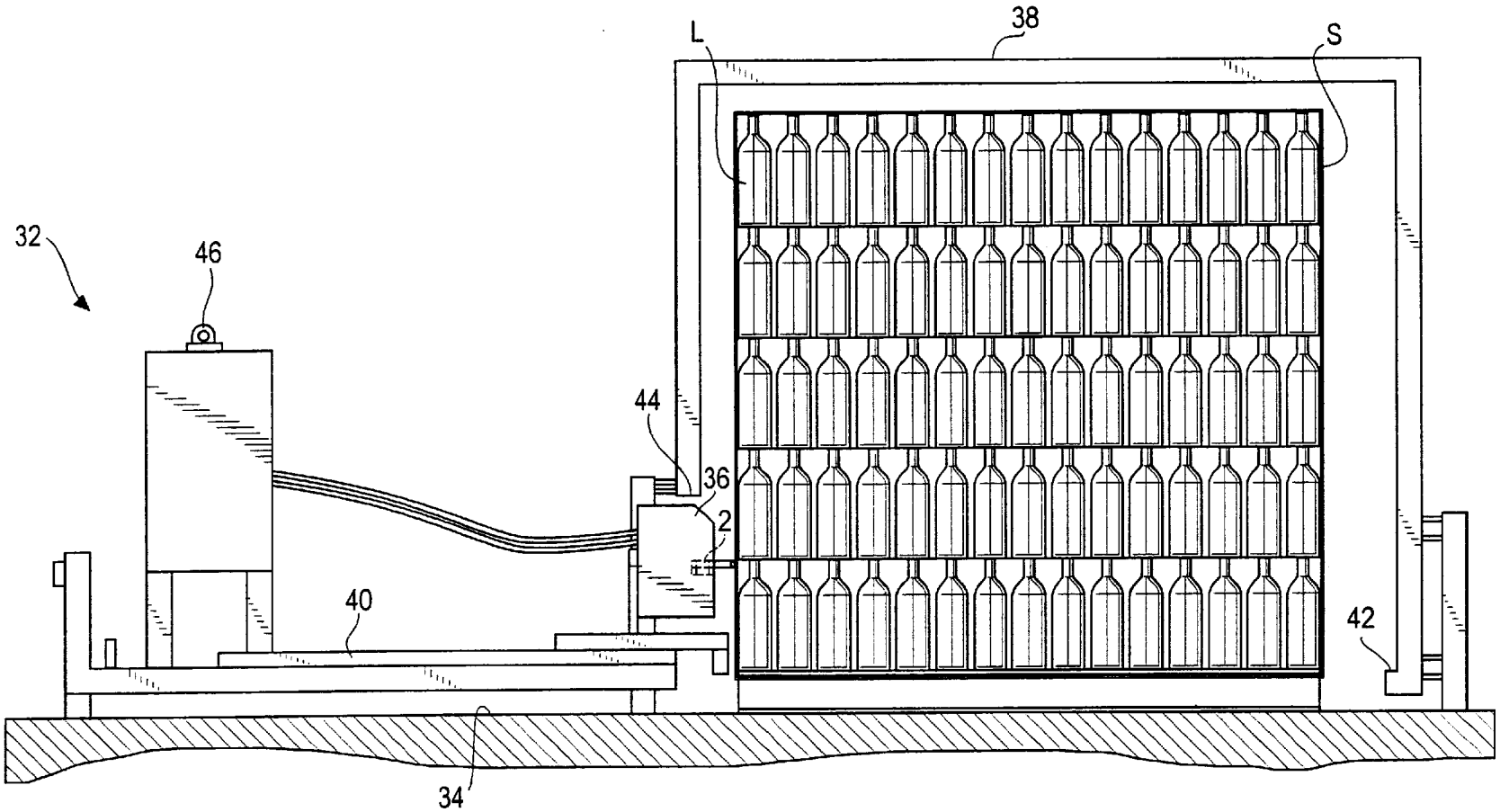
Figure 3C:
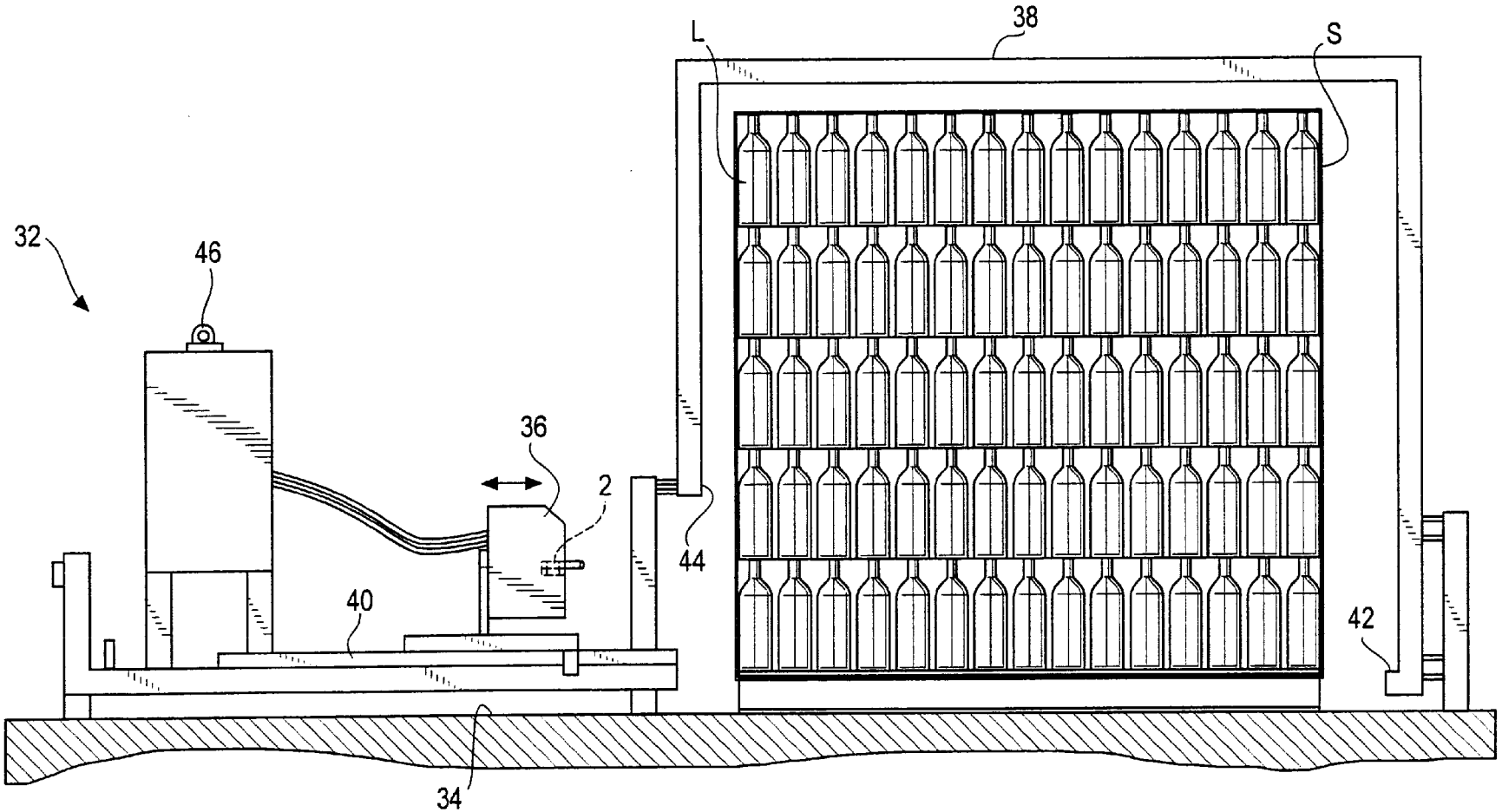

The illustrated detector assembly 2 is configured for use with an automatic strapping machine 32, such as the MCD 510/BCU-3 automatic strapping machine manufactured by ITW-Signode, of Glenview, Ill., which is schematically shown in FIG. 3. The automatic strapping machine 32 includes a strapping machine body 34, a strapping head 36, a chute 38, and the detector assembly 2. A strapping material dispenser (not shown) feeds strapping material to the machine 32 for strapping around a load L. Preferably, the illustrated detector assembly 2 of FIGS. 1–2 is mounted to the strapping head 36 of the automatic strapping machine 32.

As shown in FIG. 3, the strapping head 36 advances toward the load along a rail 40 before it begins a strapping operation. As shown in FIG. 1, at this point, the illustrated detector assembly 2 is in a home state. The strapping head 36 conveys a leading portion of strapping material to a first end 42 of the chute 38 and receives the leading portion of strapping material from a second end 44 of the chute 38. The strapping material is then gripped, retracted, sealed to itself, and cut to strap the load L together.

Occasionally, a faulty seal is formed in the strap around the load L because the strapping material was improperly gripped, retracted or sealed for example. The strapping may also have broken during one strapping operation. This inevitably results in load tippage or spillage, and because each load can include thousands of articles, each tip or spill can result in the loss of articles and employee clean up time.

Typically, several automatic strapping machines operate simultaneous at factory and/or packaging sites. Therefore, although human supervision of strapping operations may alleviate the spillage problem, such a solution is economically and commercially impractical because of the numerous automatic strapping machines that would require supervision.

The present invention allows for effective seal integrity examination without the need for constant human supervision. Pursuant to the present invention, a detector assembly 2 employing a sensing element 28 that is used to check for faulty seals is used with automatic strapping machines.

Figure 4:
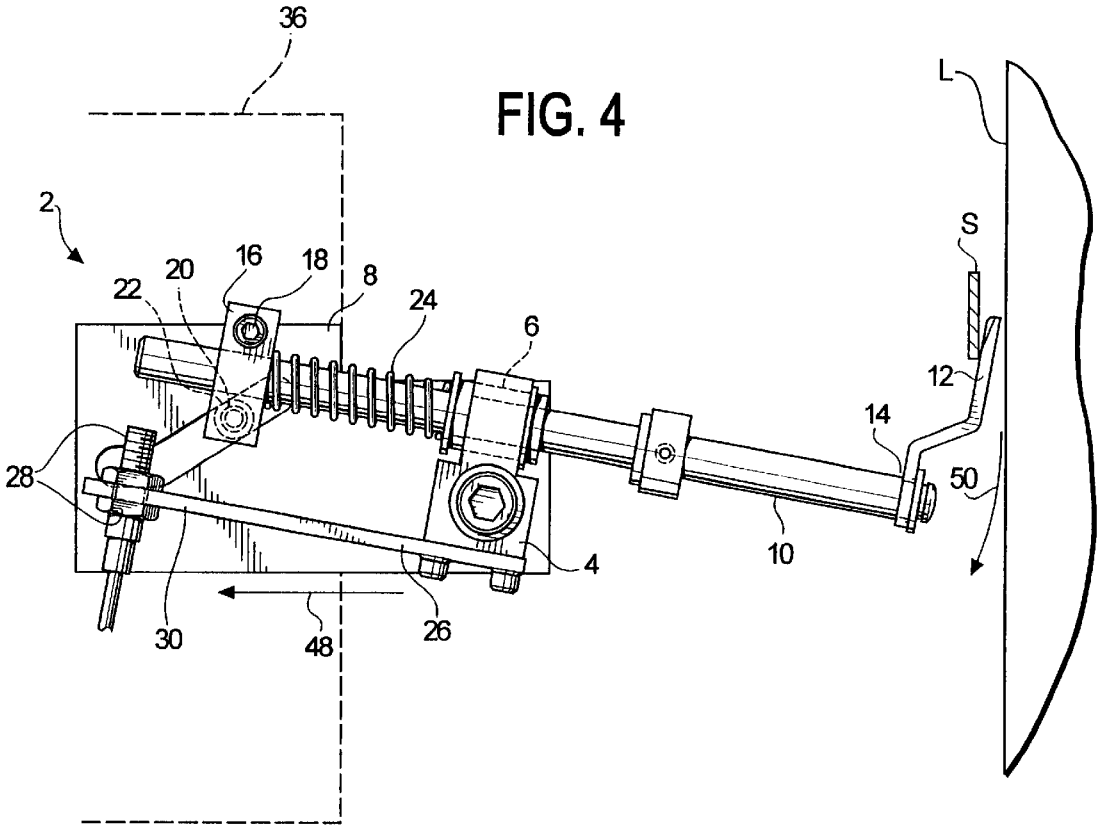
FIG. 4 is a top view of the detector assembly of FIG. 1 in the secure state.

During the strapping operation described above, when the head 36 moves to the load L to begin one strapping operation, the finger 12 is positioned adjacent the load L along the strap path, and is essentially strapped to the load. As shown in FIG. 4, after a strapping operation is complete, the finger 12 remains in position "under" the strap, and the strapping head 36 moves away from the load. When the strapping head 36 moves away from the load L, if a proper strapping operation has been performed, the detector assembly 2 temporarily changes from a home state position to a secure state position. In the secure state (FIG. 4), the finger 12 remains secured to the load L by the strapping material while the strapping head 36 moves away (as indicated by the arrow at 48), causing the guide 20 to move the guide block 16 along the cam groove 22. Preferably, as shown in FIG. 4, the cam groove 22 is at an angle relative to movement 48 of the head 34, causing the finger 12 and shaft 10 to pivot about the pivot block 4, as indicated by the arrow at 50. This causes the finger 12 to move out and away from the strapping materials. As seen in FIG. 4, as the shaft 10 and finger 12 pivot, the finger 12 "slips" past the strap S, so that the strap S remains secured around the load L. If, however, an improper strapping operation was performed, the detector assembly will simply move away from the load while still in the home state position.

As shown in FIG. 1, the guide block 4 is initially proximal to the proximity sensor 28 in the home state position. FIG. 4 shows the secure state in which the guide block 16 moves away from (e.g., is spaced from) the proximity sensor 28. When the proximity sensor 28 detects movement of the guide block 16 away from the sensor 28, a change in the state of the sensor 28 occurs. This, in the illustrated embodiment, indicates that a proper strapping operation has been performed, i.e. the guide block 16 is spaced from the proximity sensor 28 in the secure state position. When there is no change in the state of the sensor 28, this indicates that the guide block 16 has not changed position after the strapping head 36 has moved away from the load, which is indicative that a faulty operation has been performed, i.e. the guide block 16 stays proximal to the proximity sensor 28 in the home position.

Those skilled in the art will recognize the various types of proximity sensors that can be used. In a present embodiment, an inductive proximity sensor is used, which is commercially available from Turck, Inc. of Minneapolis, Minn. Other types of sensors, including other electronic, as well as electro-mechanical types detectors (e.g., limit switches and the like), their general design and use, will be recognized and appreciated by those skilled in the art. All such sensors are within the scope and spirit of the present invention.

Typically, if a proper strapping operation occurred, after the strapping head 36 has moved away from the load, the spring 24 returns the guide block 16 to a home state position, and the proximity sensor 28 resets.

If the proximity sensor 28 determines an improper strapping operation has been detected, the proximity sensor 28 can desirably actuate a notification device 46, such as, for example, an audible and/or visual alarm. Preferably, when the notification device 46 is actuated because of a faulty strapping operation, it causes the automatic strapping machine 32 to be temporarily disabled in order to prevent further faulty strapping operations. An operator can then attend to the strapping machine to resolve any problem.

In the present disclosure, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the invention. It is to be understood that no limitation with respect to the specific embodiment illustrated is intended or should be inferred. The disclosure is intended to cover by the appended claims all such modifications as fall within the scope of the claims.

What is claimed is:

1. A swap detector for use with an automatic strapping machine configured to strap articles together by conveying strapping material into a first end of chute, the strapping material exiting the chute at a second end and being sealed to itself at a strapping head, the strapping head moving away from the articles after forming a seal and toward the articles to form the seal, the strap detector being configured to determine whether the strapping material is positioned and sealed around the articles, the strap detector comprising:

a strap detector mounting bracket mounted to the automatic strapping machine, the strap detector mounting bracket having a slot having an angled portion relative to a direction of movement of the strapping head;

a pivot block mounted to the mounting bracket, the pivot block having an aperture formed therein;

a shaft positioned in the pivot block aperture;

a finger mounted to the shaft at a free end;

a sensed element positioned along the shaft spaced from the free end, the sensed element including a guide thereon configured to cooperate with the slot during movement of the sensed element to pivot the finger transverse to the direction of movement of the strapping head; and a sensor operatively coupled to the detector mounting bracket at a predetermined position relative to the sensed element, the sensor having a first state and a second state and being changeable therebetween, wherein when the finger engages strapping material positioned and sealed around the articles, movement of the strapping head away from the articles moves the sensed element and the sensor from the predetermined position relative to one another to change the state of the sensor from the first state to the second state.

2. The strap detector in accordance with claim 1 wherein the sensed element is a guide block.

3. The strap detector in accordance with claim 1 further including a sensor support bracket mounted to the detector mounting bracket, wherein the sensor is operatively coupled to the detector mounting bracket by the sensor support bracket.

4. The strap detector in accordance with claim 1, wherein the sensed element is formed as a guide block and wherein movement of the guide block along the slot pivots the finger transverse to the direction of movement of the strapping head.

5. The strap detector in accordance with claim 1 wherein the guide is a bearing.

6. The strap detector in accordance with claim 1 wherein the sensor is a proximity sensor.

7. The strap detector in accordance with claim 1 further including a biasing element positioned along the shaft to bias the sensor and sensed element to the predetermined position.

8. An automatic strapping machine configured to strap articles together by conveying strapping material into a first end of a chute, the strapping material exiting the chute at a second end and being sealed to itself, the automatic strapping machine comprising:

a strapping head, the strapping head moving toward and away from the articles, the strapping moving toward the articles to convey the strapping material into the first end of the chute and to seal the strapping material to itself, and moving away from the articles after sealing the strapping material to itself; and a strap detector, the strap detector configured to determine whether the strapping material is positioned and sealed around the articles, the strap detector including a strap detector mounting bracket mounted to the strapping head, the strap detector mounting bracket having a cam groove formed therein, the cam groove being formed as a slot having an angled portion relative to a direction of movement of the strapping head, a pivot block mounted to the mounting bracket, the pivot block having an aperture formed therein, a shaft positioned in the pivot block aperture, a finger mounted to the shaft at a free end, a sensed element positioned along the shaft spaced from the free end, the sensed element including a bearing thereon, the bearing being configured to cooperate with the cam groove during movement of the sensed element along the slot, movement of the sensed element pivoting the finger transverse to the direction of movement of the strapping head, a sensor support bracket mounted to the detector mounting bracket, the support bracket having an elongated slot formed therein, a proximity sensor mounted to the elongated slot in the sensor support bracket at a predetermined position relative to the sensed element, the proximity sensor having a first state and a second state and being changeable therebetween, and a biasing element positioned along the shaft to bias the sensor and sensed element to the predetermined position, wherein when the finger engages strapping material positioned and sealed around the articles, movement of the strapping head away from the articles moves the sensed element and the sensor from the predetermined position relative to one another to change the state of the sensor from the first state to the second state.

9. The automatic strapping machine in accordance with claim 8 wherein the sensed element is a guide block.

10. The automatic strapping machine in accordance with claim 8 wherein the strap detector mounting bracket is mounted to the strapping head.

11. The automatic strapping machine in accordance with claim 8 further including a notification device, wherein the notification device is actuated if the sensor state does not change after the strapping head moves away from the articles.

12. The automatic strapping machine in accordance with claim 11 wherein the notification device disables the strapping machine when actuated.

* * * * *